United States Patent [19]

Ebner

[11] 3,965,599

[45] June 29, 1976

[54] DISPLAY SYSTEM FOR INTERCHANGEABLE PRESENTATION AND STORAGE OF PICTURES

[75] Inventor: Emanuel C. Ebner, Chelmsford, Mass.

[73] Assignee: Foto-Cube, Inc., Chelmsford, Mass.

[22] Filed: Oct. 10, 1974

[21] Appl. No.: 513,842

[52] U.S. Cl. ..... 40/152; 40/124; 40/63 R

[51] Int. Cl.[2] ..... G09F 1/12

[58] Field of Search ..... 40/142 A, 138 R, 152, 40/152.1, 314, 154, 312, 10; D6/232–245

[56] References Cited

UNITED STATES PATENTS

| | | | |
|---|---|---|---|
| 54,208 | 4/1866 | Rice | 40/154 |
| 1,516,264 | 11/1924 | Bliss | 40/125 A X |
| 2,138,993 | 12/1938 | Bangs | 40/314 |
| 2,296,596 | 9/1942 | Brown | 40/154 |
| 2,677,910 | 5/1954 | Morgan | 40/158 R |
| 3,416,765 | 12/1968 | Ebner | 40/152.1 |
| 3,456,374 | 7/1969 | Baermann | 40/152 |

*Primary Examiner*—Hugh R. Chamblee
*Assistant Examiner*—Wenceslao J. Contreras
*Attorney, Agent, or Firm*—Weingarten, Maxham & Schurgin

[57] ABSTRACT

A display system for the interchangeable presentation of art prints or other substantially flat display objects, and for the storage of a number of such prints not being displayed. Magnets are disposed within recesses in a background member or plaque and these magnets engage metallic plates or foil elements permanently affixed to the back of a picture to be displayed for secure mounting thereof to the plaque in a predetermined orientation. A mat may be provided surrounding the displayed picture and it may also be maintained in position by magnetic means.

11 Claims, 7 Drawing Figures

DISPLAY SYSTEM FOR INTERCHANGEABLE PRESENTATION AND STORAGE OF PICTURES

FIELD OF THE INVENTION

This invention relates in general to picture display means and more particularly concerns a device for the interchangeable presentation and storage of pictures employing magnetic means for retaining the picture on the display surface of a plaque.

DISCUSSION OF THE PRIOR ART

Pictures, original works of art and art reproductions are of greatest value to the owner and others only when they can be readily viewed, enjoyed and appreciated. Means for displaying such two-dimensional articles are provided by great numbers of different devices. Most of these devices, however, do not provide for convenient interchanging of the object being displayed without damaging the object nor do they provide a convenient storage facility for a number of undisplayed pictures.

U.S. Pat. No. 3,553,872, assigned to the same assignee as the present invention, discloses a means for storing and interchangeably displaying a two-dimensional object. That invention pertains primarily to the display of rigid objects, shown as pictures, mounted on a relatively thick backing. It was not intended to permit display of a picture on flexible paper or cloth without first affixing the picture to a rigid surface.

At the present time there is a growing interest in art among people of all ages. Inexpensive art reproductions have achieved wide popularity. The inexpensive nature of such reproductions have enabled the consumer to purchase large numbers of them, but each is an incomplete product without suitable display means. Traditionally, significant time and money have been necessary to properly display an art reproduction, and esthetic, permanent framing means are often several times more expensive than the work of art or reproduction being shown. Even if he can afford many frames, because of limitations of wall space and the desire for variety in the art being displayed, the owner cannot normally display at the same time all the art reproductions that he owns. There has not heretofore been any desirable or functional display and storage means for a collection of art reproductions and similar two-dimensional objects of the type which are printed on flexible paper. The vast market which could be opened to art reproductions because of their reasonable cost and high quality is presently curtailed by the lack of a modern, inexpensive and efficient means of displaying them, a means which permits variety without requiring a tremendous amount of wall space.

A system for interchangeable display and storage of pictures in such a manner as to encourage a person to avail himself of its features should satisfy several criteria. It should allow for ease of positioning of the display object on a background surface while preventing damage to the object during mounting and removal. It should provide means for secure mounting of the object once it has been positioned in such a way as to prevent a warped or bubbled appearance of the displayed object. It is also desirable that such a device provide adequate, convenient and accessible storage space for objects not currently being displayed. A device combining these features is not evident from the prior art.

SUMMARY OF THE INVENTION

The invention disclosed herein is applicable to any flexible picture type object and is particularly of commercial significance in the field of inexpensively priced art reproductions. Generally speaking, this invention provides a novel display device for the interchangeable presentation of relatively thin, flexible two-dimensional objects of various thicknesses. More particularly, this invention comprises a background member or plaque having a display surface and a rear surface. The display surface of the background member provides a background, which may have a neutral or any desired color, for a displayed object, while the rear surface of the background member and peripheral side members formed unitarily therewith define a storage area. Magnets are disposed within recesses in the display surface of the background member at positions to engage thin sheets of metal affixed to the four corners of an object or picture being displayed. When the corners of the picture are aligned as desired with the mounting magnets, the display object is thereby positively retained in an orientation substantially parallel to and in contact with the display surface. The picture can easily be interchanged by moving its corners transversely away from the magnets and off the support member. Another picture can then be easily mounted for display.

A flexible elastic band is affixed to the storage side of the device for holding stored objects flat against the rear surface of the plaque. The storage means prevents warping and creasing of the pictures in storage and also provides a rear barrier to the storage area for preventing objects being stored therein from falling out of the plaque. Concealed means for mounting the device onto a wall are also provided. In an alternative embodiment of the invention a mat is mounted onto the background member, also by magnetic means, to extend peripherally of the displayed object. Another alternative embodiment employs sculptured edges and an inset of the display surface to provide an element of the effect of a traditional frame.

This invention stresses disconnectability versus the permanence of conventional frames used in displaying pictures. The classical frame approach to viewing prints employs glues, screws, mats, glass, clamps and frame pieces which accentuate the permanent, static, possessive, enduring and one-time uniqueness of its content. Change is not native to, nor encouraged by such a system. The intent of this invention is to stress the facility for change because the growth of an individual's power for aesthetic discrimination is directly related to the frequency of encounters he has with works of diversified creative content. The exposure and personal control permitted by this invention is analogous to the record player in the field of music, permitting, in this case, the eye to receive the necessary impact for growth. This plaque is designed for action on the part of the viewer, inviting him to become involved in a learning process he himself stimulates and at his own rate he experiences form and color rendered by masters.

BRIEF DESCRIPTION OF THE DRAWING

The objects and advantages of this invention will be more fully understood and appreciated from the following detailed description taken in conjunction with the accompanying drawing in which.

DESCRIPTION OF THE PREFERRED EMBODIMENTS

According to the invention, an esthetically pleasing and relatively inexpensive display device is provided for interchangeable presentation of art reproductions or other display objects. It will be seen from the accompanying drawing and the discussion which follows that the display device of the invention provides ease of attachment and positioning and secure mounting of a picture being displayed while providing convenient and accessible storage of pictures not currently displayed.

Figure 1:
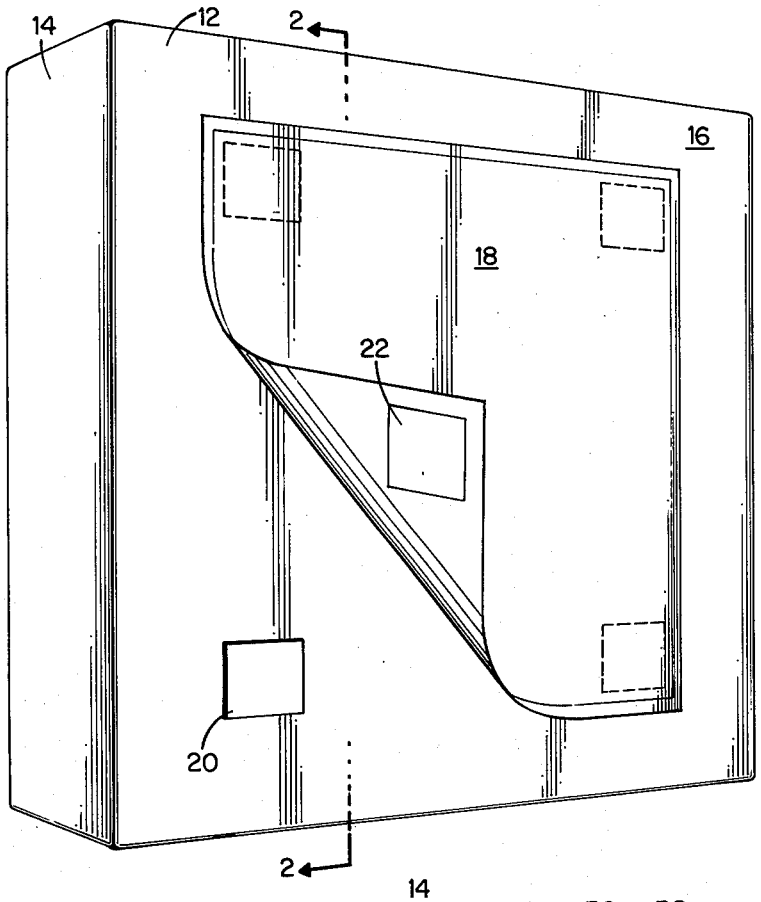
FIG. 1 is a perspective view of a preferred embodiment of the invention, showing the displayed object partially removed.
Figure 2:
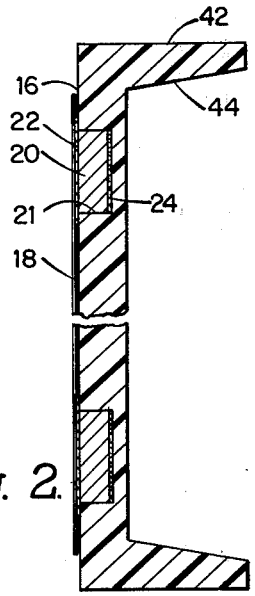
FIG. 2 is a partial cross sectional elevation of one embodiment of the invention taken along cutting plane 2—2 of FIG. 1.

The display device or plaque of the invention is shown in a preferred embodiment in the pictorial view of FIG. 1 and the sectional elevation of FIG. 2 taken at lines 2—2 of FIG. 1. A background member 12 and four identically shaped perpendicular side members 14, disposed peripherally from the background member at the edges thereof, form a unitary box-like cavity which may be mounted vertically on a wall in a manner so that a display surface 16 of background member 12 is presented to a viewer.

A display object 18 which may be a photographic reproduction of a work of art or any similar object printed on relatively thin paper or cloth is removably mounted onto the background member by magnetic means. These include magnets 20 typically formed of a magnetic material which may either be flexible or rigid which are embedded in recesses 21 formed in the background member so that the front surface of the magnet is coplanar with the display surface 16. Magnets 20 are disposed at each of the four corners of an imaginary rectangle centered with respect to display surface 16 and defined by the size of the picture which the plaque is intended to display. Keeper plates 22, typically formed of thin sheet metal or metal foil and generally of the same or slightly larger dimensions than the magnets 20, are permanently fixed, preferably by an adhesive bond, onto the back surface adjacent the corners of the picture. Magnetic attraction of the keeper plates by magnets 20 provides secure mounting of the picture 18 on the background member. The magnetic attraction of the magnets may be enhanced by providing plates 24 as pole pieces behind each magnet in the recess 21 formed in background member 12. Plates 24, which typically constitute thin pieces of metal of approximately the same surface dimensions as the magnets, are bound thereto by the magnetic attraction of the magnets and serve to improve the flow of the magnetic flux lines for more secure mounting of the picture to the display surface 16.

The particular disposition of the magnets in background member 12 permits relative ease of mounting of a picture onto the display surface. The two top corners of the art reproduction may be engaged by respective magnets on display surface 16 and moved laterally for desired alignment and orientation. Once their alignment is established the picture may then be eased flat against the display surface until the bottom magnets engage. Once all four keepers engage respective magnets and the picture is retained in parallel orientation to the display surface, only perpendicular magnetic force is applied to the keeper plates. Lateral movement thereof with respect to the magnets is prevented by the frictional resistance between the surfaces of magnets 20 and keeper plates 22 for elimination of undesirable sagging or misalignment of the art reproduction during display.

An additional advantage of placing keeper plates 22 adjacent the corners of the picture is the reinforcement thus provided to the corners and consequent protection against dog-earing or bending of the picture edges.

Figure 3:
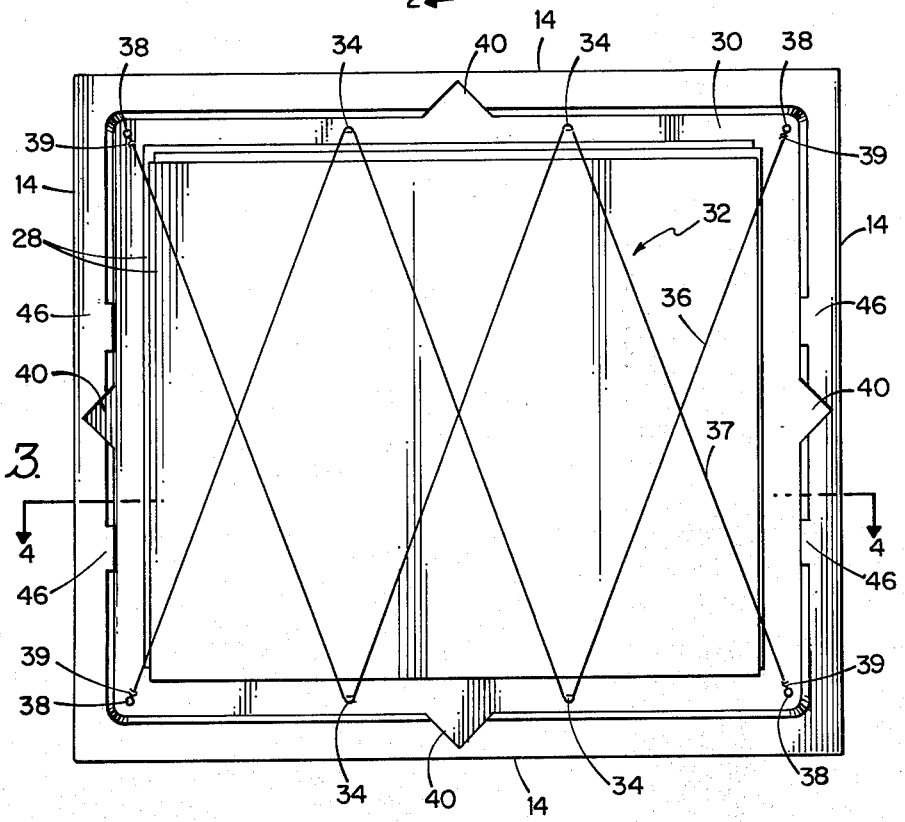
FIG. 3 is a rear elevation view of the invention.

Pictures which are not currently displayed may be stored behind the background member within the space defined by side members 14. In FIG. 3, which illustrates the back storage area of the plaque, a plurality of pictures 28 not currently being displayed are shown supported against the back surface 30 of background member 12 by an elastic grid 32. Grid 32 is typically formed of elongate elastic material such as elastic bands which is arranged in a generally symmetric criss-cross pattern about the longitudinal axis of the plaque as shown. The elastic bands are fastened to back surface 30 of background member 12 at points close to the corners formed by two adjacent side members 14 by staples 38 or similar fasteners, leaving access opening adjacent the side members 14 for insertion and removal of stored pictures. Additionally, the extreme ends of the elastic bands may be knotted to prevent inadvertent detachment thereof from background member 12. In the embodiment shown, two separate lengths of elastic material, 36 and 37, are employed and are each knotted at their ends 39 as indicated. Intermediate elements 34 may be staples or pegs around which the elastics pass.

The degree of tautness of elastic grid 32 is selected to hold prints 28 flat aginst back surface 30 and thus to prevent warping or creasing thereof, yet at the same time to permit the prints to be easily removed from the storage area without tearing or otherwise damaging them. Prints may be inserted into or removed from the storage area simply by displacing the elastic bands rearwardly from their normal position.

Figure 4:
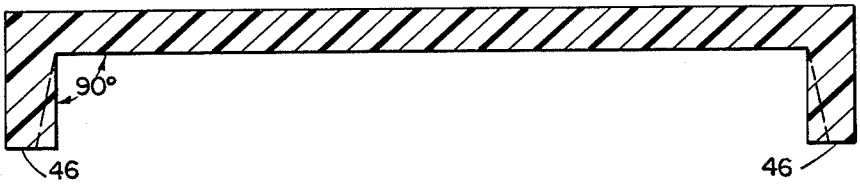
FIG. 4 is a partial cross sectional elevation of the invention taken along cutting plane 4—4 of FIG. 3.

FIGS. 2, 3 and 4 illustrate the particular configuration of side members 14. A notch 40 is formed in each of the side members 14 at their respective mid-points, presenting a triangular opening at the back facing wall of each side member and a groove of triangular cross section along the inner facing surface thereof. Notches 40 provide an invisible means of mounting the display device onto a wall or similar vertically disposed planar surface whereby a nail or other element inserted into a wall and projecting therefrom by a predetermined-distance may be seated within one notch. The plaque of the invention is constructed to be symmetric in mass about each of the notches so that when the plaque is placed upon a nail at a groove 40, it may be aligned for stable mounting in a geometrically balanced orientation and will not tend it to assume a skewed position. The plaque will remain substantially parallel to the wall and uniformly spaced therefrom by side members 14 which extend a uniform distance back from display surface 16 and form a peripheral border thereto. Provision of mounting notches 40 at each side member permits mounting of the display device in any one of four orientations.

Side members 14 are each configured to have an outer surface 42 (FIG. 2) which is generally perpendicular to the display surface of background member 12 and an inner surface 44 which forms an obtuse angle with back surface 30. The angle of surface 44 is shown exaggerated in the drawing and may be in the range of 2°, needed for draft purposes only, to permit removal of the plaque from the mold after it is formed. The outside surfaces 42 of side members 14 form a square corner while the inner surfaces are configured to form a rounded corner with an inner radius of typically one-half inch. In order to prevent inadvertent escape of the stored display objects 28 from the storage area through the open ends of elastic grid 32 should the draft angle exceed about 2½°, two pairs of bumpers 46 (FIGS. 3 and 4) having parallel inner and outer walls may be formed in the side members adjacent the open ends of the elastic grids.

The entire display device may be conveniently made of a foam plastic material such as polyurethane or a form of polystyrene by casting or molding in which staples 38 or other fasteners may be easily inserted and firmly retained. The plaque thus formed may be conveniently manufactured at relatively low cost in large quantities by methods well known in the plastic molding art and it may be made in any desired color and have any desired surface texture, including an authentic wood grain.

Figure 6:
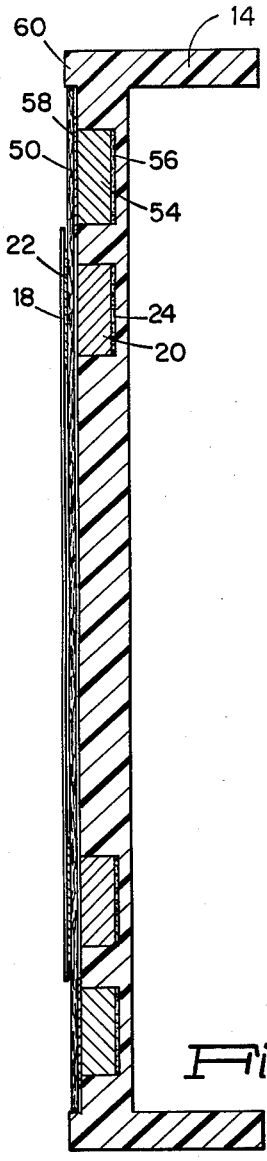
FIG. 6 is a cross sectional view of another embodiment of the invention.
Figure 5:
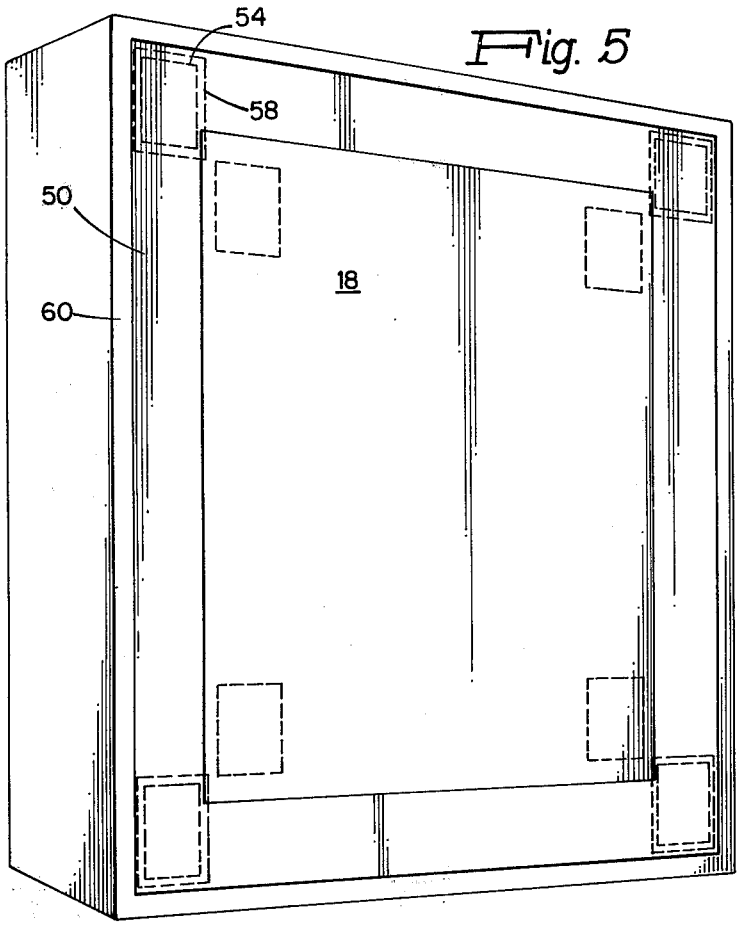
FIG. 5 is a perspective view of another embodiment of the invention.

An alternative embodiment of the invention is shown generally in FIGS. 5 and 6. As in the embodiment first described, a magnet 20 and associated plates 24 attract keeper plates 22 affixed at the corners of picture 18. In this alternative embodiment a mat 50 having an open central area with dimensions smaller than the outer dimensions of the picture 18 is superimposed over or under the periphery of display object 18 and mounted in desired orientation against display surface 16 of background member 12 to provide a matted display. Four magnets 54 and associated plates 56 engage respective keeper plates 58 affixed to the mat 50 adjacent its corners to support the mat in a desired position. In the embodiment shown, display surface 16 is recessed with respect to the forward facing edges 60 of side members 14 in order to define precisely the position of mat 50. Provision of the recess is not necessary, however, and mat 50 may be maintained in a desired orientation solely by means of a magnetic attraction between magnets 54 and keeper plates 58.

Figure 7:
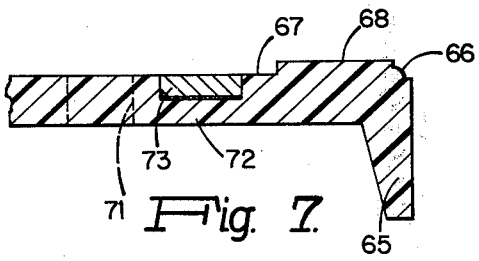
FIG. 7 is a partial cross sectional view of still another embodiment of the invention.

A further alternative embodiment is shown in FIG. 7 wherein the edges of the side members 65 are contoured at the forward corners 66 and display surface 67 is recessed from front surface 68 of the plaque to form a well. The plaque may be wood grained to give a frame effect. A hole 71 through background member 72 disposed adjacent but inwardly from magnet 73 is provided so that a finger may be inserted to force the picture away from the display surface for removal thereof. Otherwise the device is much the same as the embodiments previously described in detail.

Normally, the pictures will be a paper with a plastic laminated over the surface thereof to lend the necessary stiffness to maintain the edges straight. The embodiment of FIG. 7 permits unlaminated paper prints and canvas to be used since a slight waviness of the edge thereof would be hidden by the edges of the well. This embodiment also prevents the possibility of catching the edges of the picture and brushing it off while permitting uniform size prints to be automatically positioned within the recess. A more definite frame effect is also provided by this embodiment.

In the illustrated embodiments of the invention, magnets 20 and 54 are shown embedded in the display surface of background member 12. Alternatively, background member 12 could be formed with apertures corresponding to the planer dimensions of the magnets extending entirely through it. In such an embodiment, the magnets and associated plates would be mounted in the apertures at a desired position to present a forward surface in common with the display surface 16.

The primary purpose of the invention described above is facility in displaying and interchanging a multiplicity of display objects. This purpose is effected in the present invention by means of features which are inherent in the embodiment of the invention disclosed herein. One feature, as described, is that introduction and positioning of the display object can be easily accomplished in a short time, without injury to the prints. Also, fine adjustment of the orientation of the display object on the background surface can be easily accomplished since the magnet defines a unipolar surface with the display surface. Further, once the object is in position, sufficient magnetic attraction and resistance to lateral movement of the display object to prevent sagging or warping is provided by employing the relatively high surface friction of the magnetic material. Also, means for safely and conveniently storing objects which are not currently on display is provided. Another feature is that the display device of the invention may be easily constructed of relatively light and inexpensive materials, such as plastic, by well known fabrication methods such as casting or injection molding. The above features combine to provide a unified, self-contained device which embodies novel means for appreciating a multiplicity of works of art or other visual information. The invention enables interchangeable display of objects by combining storage and display means in a single unit immediately and conveniently at hand.

In particular, this invention embodies a novel and unique conception of merchandising, viewing and appreciating inexpensive art reproductions. At present, an art reproduction by itself cannot be immediately viewed and appreciated after purchase. Before the owner can display the reproduction, he must buy a frame and expend time and labor or money to mount the reproduction. These complications characterize the acquisition and display of an art reproduction with the nature of permanence. Since the inexpensive cost of art reproductions now makes it possible for a person to acquire a multiplicity of such prints, the invention disclosed herein makes it practical to display and enjoy them. The means embodied in the invention encourage people to vary their displays of art to suit their mood, or to whet their appetite for art by experimenting with the knowledge that if they are not pleased with the print when it is displayed, they can remove it easily and replace it with another.

Various modifications and alternative implementations will occur to those skilled in the art without departing from the true scope of the present invention. Accordingly, it is not intended to limit the invention by what has been particularly shown and described, except as indicated in the appended claims.

What is claimed is:

1. A display device comprising:

a background member having a display surface and a back surface;

a non-rigid two-dimensional display object;

a plurality of thin metallic keeper plates affixed in spaced relationship to the back surface of said display object;

a like plurality of magnets embedded in said display surface in a spaced configuration substantially the same as the arrangement of keeper plates on said display object; and side members extending rearwardly from said background member to form, with said back surface, an open rearwardly facing box-like cavity of substantially the same lateral dimensions as said display object adapted for flat storage of additional display objects;

whereby said display object is removably retained on said display surface by means of mutual engagement between said magnets and said keeper plates.

2. The display device recited in claim 1 and further comprising:

elongated elastic bands secured in a grid arrangement to said back surface of said background member;

whereby additional display objects may be stored in said box-like cavity.

3. The display device recited in claim 1 wherein at least one of said side members is formed with a rearwardly opening indentation to accept a hanging element projecting from a wall to hang said display device thereon.

4. The display device recited in claim 1 wherein the front surfaces of said magnets are flush with said display surface.

5. The display device recited in claim 1 wherein said display surface is recessed in said background member to form a well within which said magnets are located and within which said display object is confined.

6. The display device recited in claim 5 wherein said background member is formed with holes therethrough adjacent and spaced inwardly from said magnets to permit said display object to be pushed away from said display surface for interchanging said display object.

7. A display device for the interchangeable presentation of non-rigid two-dimensional display objects comprising:

a background member having a display surface and a back surface;

a plurality of thin metallic keeper plates affixed in spaced relationship to the back surface of said display object;

a like plurality of magnets embedded in said display surface in a spaced configuration substantially the same as the arrangement of keeper plates on said display object;

side members extending rearwardly from said background member to form, with said back surface, a rearwardly facing box-like cavity; and elongated elastic bands secured in a grid arrangement to said back surface of said background member, whereby additional display objects may be stored in said box-like cavity;

said display object being movably retained on said display surface by means of mutual engagement between said magnets and said keeper plates.

8. The display device recited in claim 7 wherein said display surface is recessed in said background member to form a well within which said magnets are located and within which said display object is confined.

9. The display device recited in claim 8 wherein the front surfaces of said magnets are flush with said display surface.

10. The display device recited in claim 7 and further comprising:

a mat having external dimensions greater than the external dimensions of said display object and an internal opening smaller than said display object, said internal opening being larger than the area defined by said configuration of magnets;

a plurality of thin metallic keeper plates affixed in spaced relationship to the back surface of said mat; and a like plurality of magnets embedded in said display surface in a space relationship substantially the same as the arrangement of keeper plates on said mat;

whereby said mat is removably retained on said display surface by means of mutual engagement between said magnets and said keeper plates, said mat providing a border around said display object.

11. The display device recited in claim 9 and further comprising metallic plates secured by magnetic attraction to the back surface of each of said magnets within said background member.

* * * * *